United States Patent [19]

Boulet

[11] 4,114,289

[45] Sep. 19, 1978

[54] DRYER SYSTEM

[76] Inventor: William Paul Boulet, 4945 St. Roch Ave., New Orleans, La. 70122

[21] Appl. No.: 700,809

[22] Filed: Jun. 29, 1976

Related U.S. Application Data

[62] Division of Ser. No. 549,945, Feb. 14, 1975, Pat. No. 3,976,018.

[51] Int. Cl.[2] ..... F26B 17/12

[52] U.S. Cl. ..... 34/173; 34/174; 34/168

[58] Field of Search ..... 34/66, 67, 86, 173, 34/174, 169, 168; 110/8 R, 15; 122/2

[56] References Cited

U.S. PATENT DOCUMENTS

| | | | |
|---|---|---|---|
| 1,653,332 | 12/1927 | Baechler | 34/173 |
| 2,030,734 | 2/1936 | Baird | 34/173 |
| 2,107,127 | 2/1938 | Raisch | 34/173 |
| 3,175,302 | 3/1965 | Retali et al. | 34/174 |

FOREIGN PATENT DOCUMENTS

| | | | |
|---|---|---|---|
| 504,956 | 5/1939 | United Kingdom | 34/173 |

*Primary Examiner*—Kenneth W. Sprague
*Assistant Examiner*—James C. Yeung
*Attorney, Agent, or Firm*—C. Emmett Pugh & Associates

[57] ABSTRACT

A fuel dryer system for waste fuel boilers, such as for example those in the sugar cane processing industry where bagasse is used as a primary fuel, in which the dryer comprises an assembled, enclosed, vertical dryer structure of basically cylindrical shape through which hot drying gases flow with a conical materials collecting hopper and bottom discharge, having alternating conical-shaped rotating and fixed materials trays over which the materials (e.g. bagasse) to be dried move in a net direction from top to bottom (note Figure 1). Adjustable wipers are provided with the conical materials trays, with access portholes at each tray level. In the sugar cane boiler system the stack gases from the boiler are used for the hot drying gases (note Figure 5).

8 Claims, 5 Drawing Figures well as the angle of position, and, further that the angle is unrestricted relative to the surface of the rotating cones 15 and the solids moving thereon. The wiper "blade" may be made in any shape which might be advantageous to obtain the flow rate and degree of agitation desired, and this shape is meant to include flexible shapes, curved or straight shapes, toothed or perforated shapes, and any combination of materials and shapes which will aid in obtaining the desired effects.

Figures 1, 4:
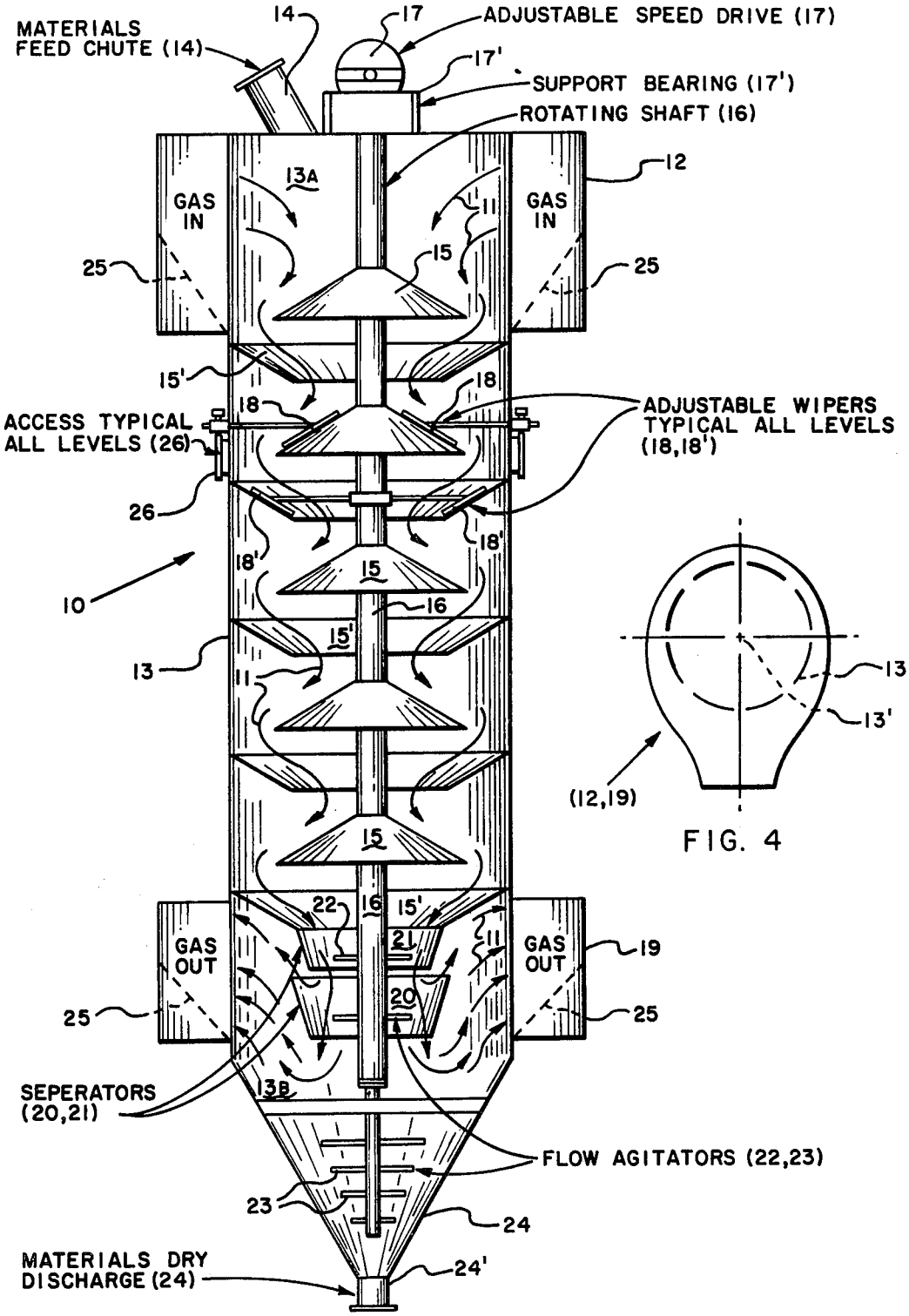

In a similar manner, the flow of materials which fall from the inner rotating cones 15 onto the outer (fixed position) cones 15' is regulated on the fixed outer cones 15' by the combined action of the drying stream of hot gases 11 and the adjustable moving wipers 18' attached to the rotating shaft 16 or to anything attached to the rotating shaft 16. As illustrated, the moving wipers 18' are attached directly to the shaft. These moving wipers 18' are adjustable as to position, angle, configuration and flexibility, as are the fixed wipers 18 described above. The gas stream 11, flowing between the bottom of the rotating cone 15 and the buildup of materials dropped onto the next lower fixed cone 15', combines its velocity, pressure, and turbulence with the action of the rotating wipers 18' to keep the materials on the lower cones 15' moving toward the dropoff point, where the materials fall onto the inner rotating cones 15; this cycling from the inner cone 15 to the outer cone 15' and down to the next inner cone 15 continues until the materials have reached the bottom section **13*b* of the dryer 10**.

The gas flow velocity increases at any level where the buildup of materials on a cone increases. Therefore the force of the gas stream 11 at such higher velocity locations will help move more of the materials while the higher velocity exists. Conversely, at locations where there is less material collected on a given cone, the gas velocity is less, thereby reducing the velocity pressure tending to force the materials down the slope of the cone. Hence the dryer 10 of the present invention has an inherent self-regulating characteristic tending to maintain an even flow and distribution of materials at all levels down to the bottom section of the dryer 10.

The angle of slope of the fixed and rotating conical surfaces 15, 15' is a variable which will differ according to the service of the dryer 10. Factors determining these angles include the materials to be dried, and the volume, temperature and composition of the drying gases 11. The angle of slope of these cones need not be the same, but may be selected according to the design needs at each level. Thus, a very flexible design capability exists by virtue of this angle of slope selection. This flexibility is increased for a given dryer unit if the cones are constructed so as to be removable without damage to the other parts of the dryer. With such removability, the replacement of the conical elements 15, 15' can be economically effected (as compared to the cost of replacing the entire dryer unit), whenever wearing of these conical surfaces requires repair or replacement, or whenever a change of drying and/or wear characteristics is desired for the dryer unit 10. In this latter case, the replacement of cones 15, 15' could be with cones of a different slope, or diameter, or material, or whatever factor would be desired. It is also possible with such a replaceable capability of the cones 15, 15' to vary the vertical spacing of the cones from the original setting. This would allow an additional flexibility of control of the overall drying and flow characteristics for both the gases and the materials.

Lastly, these cones 15, 15' might be modified as to surface configuration. While maintaining the characteristic downslope, the surface of the conical surface could be modified. For example, the change from a simple conical surface to a conical-like surface with varying slope (generated by rotation of other than a straight line about the conical axis) would permit use of all the previously described methods and devices which give flexibility of design and control of flow, while achieving a change in the overall characteristics of the conical-like surface insofar as its tendency to retain or discharge solids at a given level or radial position within the dryer. The flow characteristics of the drying gases 11 would also be affected by such a change in slope configuration. For example, if all the rotating inner cones 15 were made with curved convex downslope, and the fixed outer cones 15' were made with a curved concave downslope, and these curves were proportioned to assist smooth aerodynamic flow of gases, the gases' flow pressure losses would be reduced, as compared to most similarly spaced arrangements using pure conical surfaces with straight-line slopes. The infinite combination of such modified slope profiles substantially increases the latitude for designing dryer characteristics to match the characteristics of the materials to be dried and the drying gases.

In order to provide ready access to the internal workings of the dryer 10, e.g. to the conical trays 15,15' and/or the adjustable wipers 18,18', access portholes 26 are provided at each level. It is noted that, for simplicity purposes, the access portholes 26 and the adjustable wipers 18,18' are not illustrated at every level in the drawings. However, as the legends in the drawings indicate, they should be considered as being provided at every level in the preferred embodiment.

As the materials near the bottom 136 of the dryer 10, the separation of most of the gaseous and solids materials is effected by the steep slope conical separators 20, 21, which may be in any practical number, spacing and depth as is suited to the requirements of separation. These separators 20, 21 use the principle of difference in density to assist the separation of solids from the gases as the gases 11 turn toward the discharge shroud 19 of the dryer 10. The solids of coarser size and greater bulk density will naturally fall to the conical hopper 24, while the gases and finer solids will tend to separate at reducing velocity as they approach the outer discharge shroud 19. The gases 11, with whatever entrained solids have not separated out, will then leave the cylindrical body 13 of the dryer 10 through openings therein (not specifically illustrated), and flow into the discharge shroud 19 external to the dryer cylinder 13.

The shroud area 19 is marked "GAS OUT" in FIG. 1 which illustrates a dryer 10 with a net downflow direction for gases 11. For some applications it might be more desirable to have the hot drying gases 11 flowing upward through the dryer 10, that is to say, against the downflow of the solids being dried. The selection of concurrent (downflow) flow or counterflow (upflow) of drying gases will be determined in each case by the overall design requirements.

In the case of the upflow of gases, however, certain of the characteristics described above for concurrent flow will be altered, such as the augmenting effect of the gas velocity pressure on the downflow of solids will be reversed, and thus tend to counter the solids downflow. The advantages and disadvantages of each gases flow direction will, in each case, determine which is to be chosen for a given application. One important characteristic of the dryer of the present invention is the forced crossflow of solids and gases at each location within the dryer where the solids drop off the bottom of the cones 15, 15' to the next lower cone level. This crossflow aids the drying effect by forcing the gases and solids to intermix, thus improving the contact of the hot gases 11 with the solids. As is obvious from the drawings, particularly FIG. 1, this crossflow occurs regardless of whether the gaseous flow direction is up or down with the dryer 10.

The "Flow Agitators" 22, 23 shown are attachments to the rotating shaft 16 and are placed where needed to prevent choking or bridging of the solids in the bottom segment 13 of the dryer. The dimensions, and configuration will depend on the material being agitated and dried. In general, the agitators 22, 23 will be attachments to the rotating shaft 16, producing a stirring action. The construction may be either rigid or flexible, depending on the design choice for the material being agitated.

The "Materials Dry Discharge" 24' empties the hopper 24 for carryoff to other devices and equipment. The hopper 24, besides conical, could be of any other convenient or appropriate shape.

It should be realized that there will often, but not necessarily always, be a need to provide a continuous, peripheral, inner sloped surface (note phantom lined elements 25) at the vicinity of the bottom of either or both of the shrouds 12, 19 to prevent retention of any of the solids flowing through the dryer 10. The angle of inclination of such sloped surfaces 25 would be such as to assure that the particular solids being dried would not collect at these locations, but would be discharged below the shrouds 12, 19. The sloped surfaces 25 thus described might be either the outer encasing lower portion of the shroud 12, 19, or a built-in surface within the shroud 12, 19 itself. The inclusion of such a sloped surface 25 in either shroud would not necessarily require the use of such a surface in the other shroud.

Figure 2:
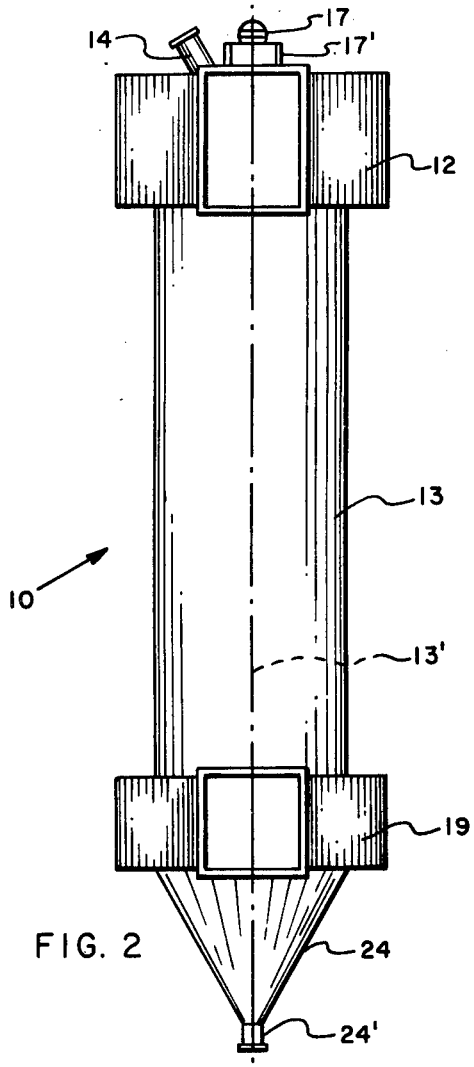
Figure 3:
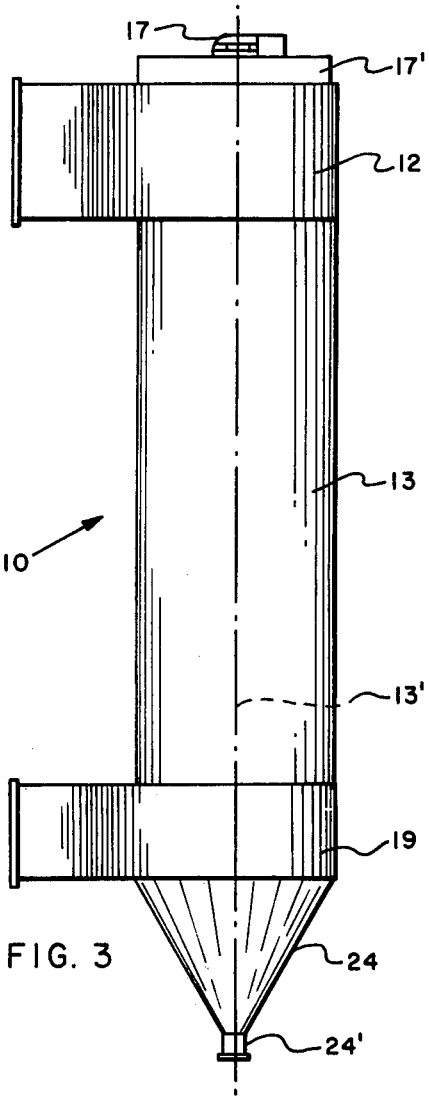
Figure 5:
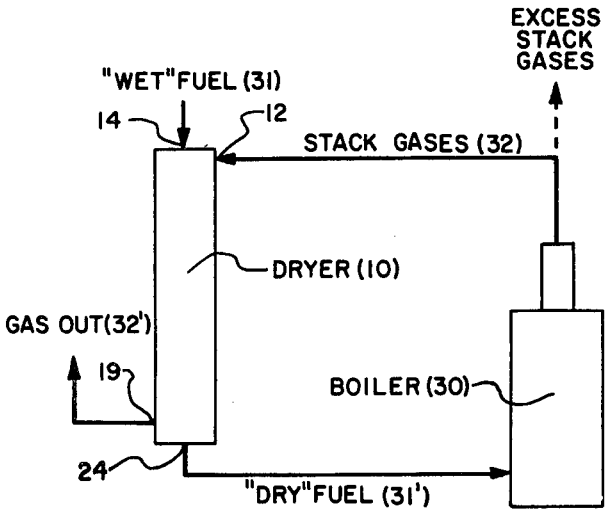

While the inlet and outlet shrouds 12, 19 are conceived in the general, pear-shape, curved form shown in FIG. 4, the shape shown is only general and not definitive, except that the shroud should be symmetrical about the line of flow (viewed from above or below) of the entering or leaving gases 11. This shape is basically meant to feed the system gases in a line toward the body centerline 13' of the dryer cylinder 13. The purpose of this is to assure that there is a balance of gas flow, preventing a vortex pattern within the body of the dryer 10. A vortex pattern would result in gas flow patterns which would not be desirable from the standpoint of achieving the interaction of solids and gases described herein and would contradict the described interaction pattern. As seen in FIGS. 2 and 3, the gas inlet and the gas discharge outlet of the shrouds 12, 19 are positioned at the same angle with respect to the centerline 13'. However, they should be aligned as appropriate as required for each installation and need not be at the same angle.

The motive power for flow of gases is external to the dryer 10 and may be either upstream or downstream of the dryer 10. The usual gas movers for this type of equipment are fans or blowers (not illustrated) which develop a pressure curve of increasing pressure with reducing volume, and vice versa. The above described functions of the gases with respect to developing velocity pressure and/or static pressure at points of restricted passage are based on such a typical pressure-volume characteristic. Depending on whether the shroud 19 can be vented as "cooled" gases 32' to the atmosphere or further treated or used as a treating agent, as appropriate.

While it is desirable and advantageous to perform the drying action above described without the expenditure of auxiliary fuel, such as oil or natural gas, this should not be construed as limiting the ability of this dryer design to be used, wherever desirable or necessary, with any source of hot drying gases. Thus, the dryer design described might be appropriately and advantageously used to dry any suitable material with any suitable source of hot drying gases. The additional advantages when drying "wet" fuel associated with a waste fuel boiler system, of which this design dryer is an integral part, have already been described in connection with a sugar cane boiler plant. Additionally, other typical examples of waste fuel applications for the principles of the present invention besides sugar cane processing plants are paper mills using wood and bark as a waste fuel, and coffee processing plants using spent coffee grounds as a waste fuel.

The dryer 10 thus uses hot boiler effluent or stack gases 31 as its source of heat, and it requires no other source for its operation. Set out below are projected performance standards within the range of removing 50% to 70% of the bagasse moisture with the use of the present invention. These projected performance standards are a calculated approximation to actual performance, which in each case will, of course, depend on the existing operation conditions of each particular boiler.

| Bagasse Dryer Performance at 70% and 50% Drying Effect | | |
|---|---|---|
| Moisture removed, % of original | 70% | 50% |
| Assumed initial moisture, % of bagasse weight | 52% | 52% |
| Moisture removed, Lbs./Lb. Wet Fuel | .354 Lb. | .260 Lb. |
| Dryer inlet temperature, ° F | 650° | 614° |
| Dryer outlet temperature, ° F | 272° | 325° |
| Temperature drop in dryer, ° F | 378° | 289° |
| Increase in net heat available, BTU/Lb. Wet Fuel | 290 BTU | 212 BTU |
| Increase in boiler efficiency (Original = 55%) | +13.9% | +10.2% |
| Increase in boiler efficiency (Original = 50%) | +15.3% | +11.2% |
| Additional boiler hp per 1000 TPD cane flow | +288 HP | +211 HP |

It should be noted that in the above calculations the dryer inlet temperatures shown are based on an assumed present effluent temperature of 550° F, which will increase to the calculated temperature shown. This higher effluent temperature derives from an increased combustion efficiency and a maximum assumed excess air ratio of 1.60 burning the dried bagasse.

In closing it is noted that the drawings and the foregoing detailed description should not be interpreted as defining specific dimensions, or materials of construction, nor should the use of the drawings infer any restriction or limitation on the types of materials which could advantageously be dried in a dryer of the particular design of the preferred embodiment. The dryer of the present invention is intended to apply to any and all combinations of materials and gas streams which are capable of producing the desired drying effect, using the construction and methods for example available from this disclosure. Also, while the drawings illustrate an implied metallic construction, the selection of materials is not limited to this.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A vertical dryer system for solid materials comprising:

an elongated, at least generally vertically disposed, hot gas/materials interaction drying chamber;

a gas inlet at one end of said chamber and a gas outlet at the other end of said chamber, structural conduction means for conducting the hot gases being conducted through the length of said chamber from said gas inlet to said gas outlet in at least generally uniform, evenly distributed, non-vortex flow; and a solid "wet" materials inlet at the top of said chamber and a solid "dry" materials outlet at the bottom of said chamber, said solid materials falling through said chamber at least partially under the influence of gravity from said materials inlet to said materials outlet, said hot gases and said solid materials intermixing together in said chamber, drying said solid materials.

2. The dryer system of claim 1 wherein there is provided an internal supportive structure and an external supportive structure, and there is further included at least one set of alternating, downwardly included surfaces located in the path of flow of said hot gases and the falling solid materials, one of said inclined surfaces emanating from said internal structure and the other emanating from said external structure.

3. The dryer system of claim 2 wherein said internal structure rotates with respect to said external structure, said chamber is at least generally cylindrically shaped, said inclined surfaces form conical-like surfaces, said external structure is the main body of said chamber, and said internal structure is a shaft which at least generally coincides with the axis of the cylindrical shape and with the axis of said conical surfaces.

4. The dryer system of claim 2 wherein there is further included a set of matching wiper blades positioned above said inclined surfaces.

5. The dryer system of claim 4 wherein the wiper blade for said inclined surface emanating from said internal structure is supported on said external structure and the wiper blade for ssid inclined surface emanating from said external structure is supported on said internal structure and moves therewith.

6. The dryer system of claim 2 wherein there is a series of sets of alternating, downwardly inclined surfaces located serially in the path of flow of said hot gases and said falling solid materials.

7. The dryer system of claim 1 wherein at least one of said gas inlet and said gas outlet is in the form of a shroud which is symetrical about a plane through the centerline of flow of said hot gases in said shroud, and the centerline of said chamber.

8. A vertical dryer system for substantially light bulk density solid materials comprising:

an elongated, at least generally vertically disposed substantially cylindrical, hot gas/materials interaction drying chamber;

a gas inlet shroud at one end of said chamber and a gas outlet shroud at the other end of said chamber, said shrouds being substantially symmetric about the line of flow of gases through said chamber, hot gases being conducted through the length of said chamber from said gas inlet to said gas outlet in at least generally uniform, evenly distributed, non-vortex, downward flow;

a "wet" solids materials inlet at the top of said chamber and a "dry" solids materials outlet at the bottom of said chamber, said solid materials falling through said chamber at least partially under the influence of gravity from said materials inlet to said materials outlet, said hot gases and said solid materials intermixing together in said chamber, drying said solid materials, said solid materials being light in relative bulk density;

an internal supportive structure;

an external supportive structure; and at least one set of alternating, downwardly inclined conical-like surfaces located in the path of flow of said hot gases and the falling solid materials, one of said inclined surfaces emanating from said internal structure and the other emanating from said external structure, said materials moving on the downslope of said conical surfaces.

* * * * *